US005918916A

United States Patent [19]

Kajuch

[11] Patent Number: 5,918,916

[45] Date of Patent: Jul. 6, 1999

[54] AUTOMATIC DEADBOLT WITH SEPARATE TRIGGER

[75] Inventor: Pete Kajuch, Brookfield, Ill.

[73] Assignee: Schlage Lock Company, San Francisco, Calif.

[21] Appl. No.: 08/995,626

[22] Filed: Dec. 22, 1997

[51] Int. Cl.[6] ..... E05C 1/08

[52] U.S. Cl. ..... 292/163; 292/169.13; 292/169.14; 70/143

[58] Field of Search ..... 292/163, 169.13, 292/169.14, 169.15, DIG. 44; 70/143, 144, 145

[56] References Cited

U.S. PATENT DOCUMENTS

| | | | |
|---|---|---|---|
| 3,112,944 | 12/1963 | Adler | 292/169.13 |
| 3,586,361 | 6/1971 | Ohno | 70/143 |
| 3,819,214 | 6/1974 | Hart et al. | 292/169.13 |
| 3,823,585 | 7/1974 | Spon | 292/169.14 |
| 3,876,236 | 4/1975 | Best et al. | 292/169.13 |
| 3,912,309 | 10/1975 | Fischer et al. | 70/143 |
| 4,729,585 | 3/1988 | Lin | 292/169.13 |
| 4,765,663 | 8/1988 | Raymond et al. | 292/169.13 |
| 4,779,908 | 10/1988 | Foshee et al. | 292/163 |
| 5,044,182 | 9/1991 | Totten | 292/169.13 |
| 5,513,505 | 5/1996 | Dancs | 70/107 |
| 5,516,160 | 5/1996 | Kajuch | 292/1.5 |
| 5,611,581 | 3/1997 | Ghostley | 292/169.13 |
| 5,713,612 | 2/1998 | Kajuch | 292/36 |
| 5,794,991 | 8/1998 | Smallegan et al. | 292/169.13 |
| 5,820,177 | 10/1998 | Moon | 292/335 |

*Primary Examiner*—Darnell M. Boucher
*Assistant Examiner*—Stephen Grady
*Attorney, Agent, or Firm*—Michael H. Minns

[57] ABSTRACT

An automatic door latch has a case and a bolt movable within the case between a fully extended position in which the bolt extends forwardly of the case and a partially extended position in which the bolt is positioned to contact a door strike. There is a plunger mounted on the bolt, with the bolt and plunger being relatively movable. A spring biases the bolt toward a fully extended position and a spring biases the plunger outwardly of the case. The plunger has a projection which limits outward movement of the plunger to a position in which its extension is the same as that of the bolt when it is in its partially extended position. There is a stop on the bolt movable toward and away from the case and there are projections on the case which coact with the bolt stop to limit bolt extension to its partially extended position. The plunger has a cam cooperating with the bolt stop to cause movement of the stop away from the case and toward the bolt during outward movement of the bolt relative to the plunger to permit the bolt to move to a fully extended position.

13 Claims, 4 Drawing Sheets

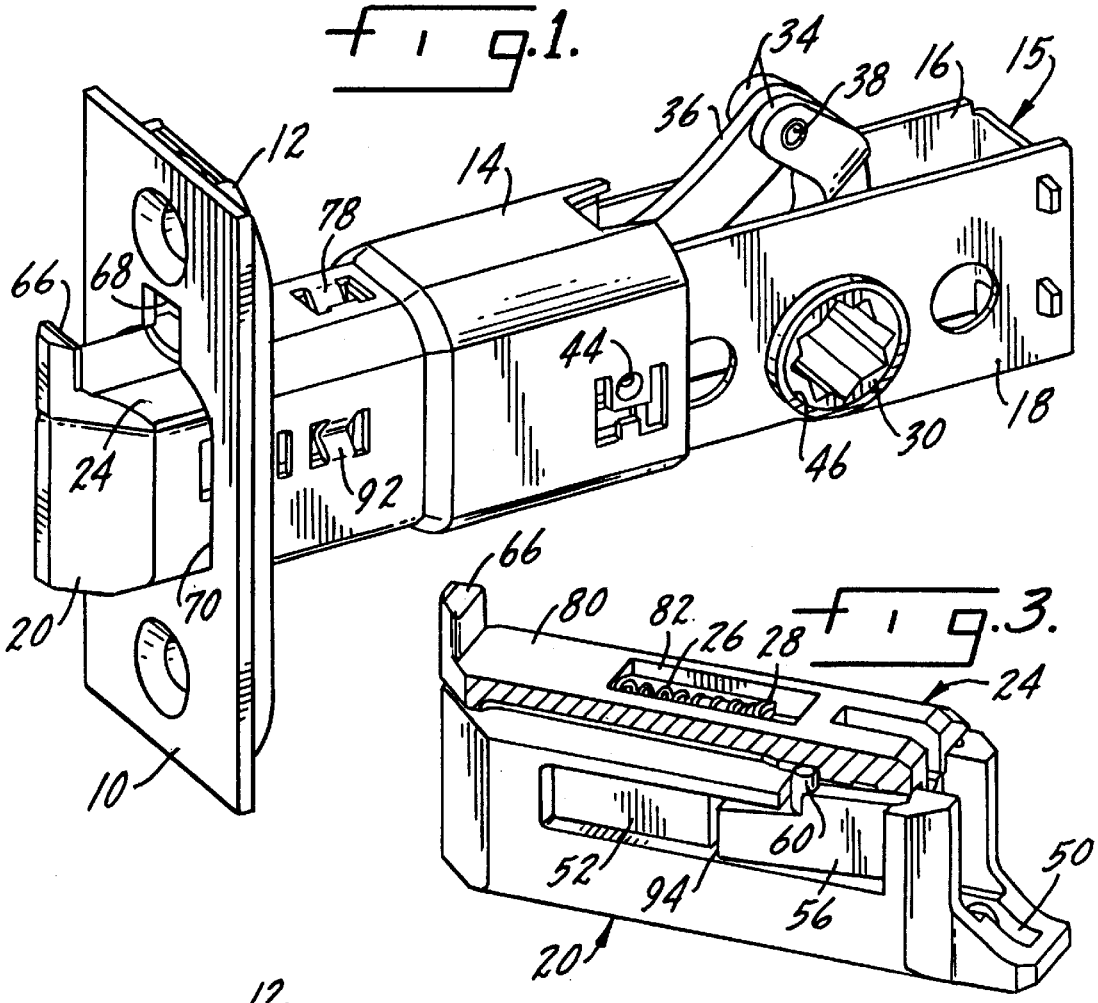
Fig.1.
12
14
15
16
18
20
24
30
34
36
38
44
46
66
68
70
78
92
10
Fig.3.
66
80
82
26
28
24
60
52
94
56
50
20
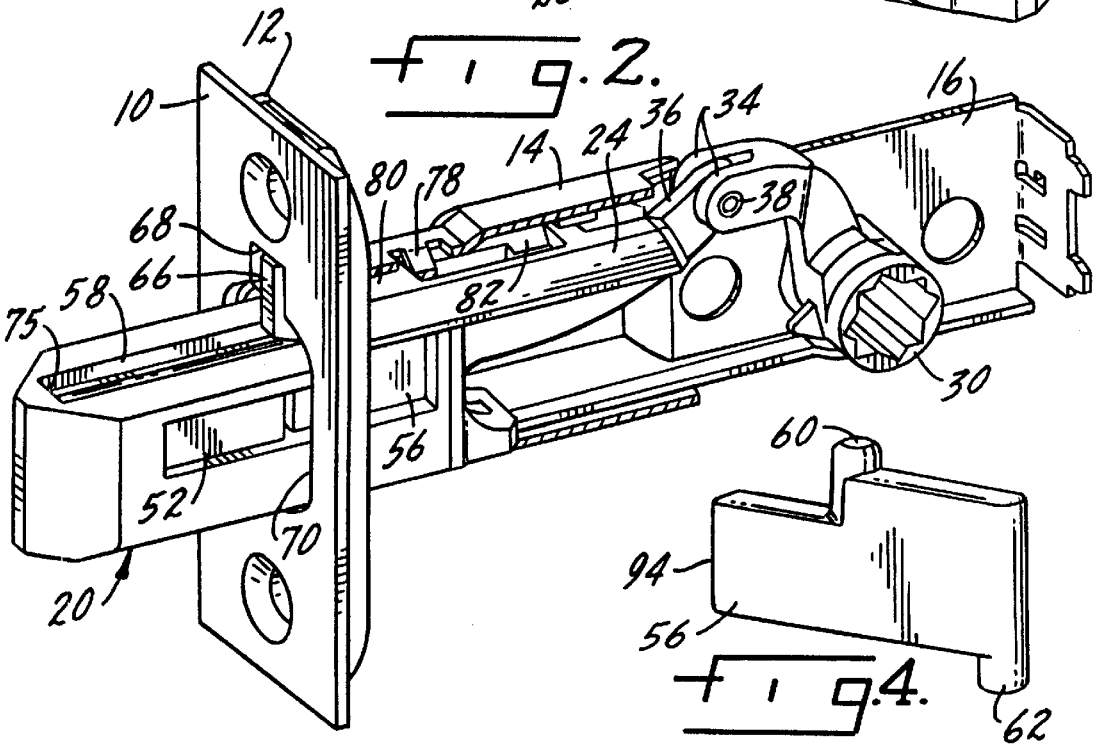
Fig.2.
12
10
14
24
36
34
16
80
78
38
68
66
58
75
82
30
56
52
70
20
60
94
56
62
Fig.4.

AUTOMATIC DEADBOLT WITH SEPARATE TRIGGER

THE FIELD OF THE INVENTION

The present invention relates to an automatic door latch and more specifically to a door latch in which the bolt automatically extends to its full deadlocking position when the door is closed. U.S. Pat. No. 5,516,160, owned by Schlage lock Company, the assignee of the present application, shows such an automatic deadbolt in which contact between the bolt and the door strike causes the bolt to move to a fully extended position. In the present invention, a plunger or trigger mechanism has been placed on top of the bolt and contact between the plunger and the door strike has the effect of automatically moving the bolt to its fully extended position when it is directly in alignment with the opening in the door strike.

When the door is open, the bolt and its related plunger are in a partially extended position in which they protrude outwardly from the door faceplate a distance of approximately ½". Upon closure of the door, the plunger and bolt are moved inwardly by contact with the door strike. When the bolt is fully aligned with the opening in the door strike, the stops which had been holding the bolt from moving to a fully extended position are retracted by the plunger, with the result that the bolt can be fully extended into a deadlocking position.

SUMMARY OF THE INVENTION

A primary purpose of the invention is an automatic deadbolt having a simultaneously movable bolt and plunger, with contact between the bolt, plunger and door strike causing the deadbolt to move to a fully extended position upon door closure.

Another purpose is a simply constructed reliably operable deadbolt which automatically extends to a full locking position upon contact between the deadbolt plunger and the door strike.

Other purposes will appear in the ensuing specification, drawings and claims.

BRIEF DESCRIPTION OF THE DRAWINGS

The invention is illustrated diagrammatically in the following drawings wherein:

FIG. 1 is a perspective of the deadbolt of the present invention;

FIG. 2 is a perspective, similar to FIG. 1, showing the deadbolt in a fully extended position and a portion of the lock case removed;

FIG. 3 is a perspective of the bolt and plunger;

FIG. 4 is a perspective of a bolt stop;

DESCRIPTION OF THE PREFERRED EMBODIMENT

The automatic deadbolt of the present invention will be described as a self-contained unit in which the spring providing the energy to move the deadbolt to an extended position is located within the latch mechanism. The invention is equally applicable to what is known as an interconnected lock assembly in which the deadbolt is combined with a latch and with both locking elements being simultaneously operated by a single handle. In such an interconnected lock assembly, for example as shown in U. S. Pat. No. 5,513,505, assigned to Schlage lock Company, the assignee of the present application, the necessary spring force to move the deadbolt to a fully extended position is provided by the interconnected lock assembly itself and not by a spring housed specifically within the deadbolt mechanism. The automatic deadbolt of the present invention is specifically directed to the deadbolt mechanism and encompasses such a mechanism in which the spring is an integral part of the mechanism or the spring may be outside of the mechanism, but directly related thereto such as in the '505 patent. Such an interconnected lock assembly is also shown in copending application Ser. No. 08/589,404, filed on Jan. 22, 1996, entitled "Adjustable Interconnected Lock Assembly With Automatic Deadbolt, now U.S. Pat. No. 5,713, 612."

Figures 5, 6:
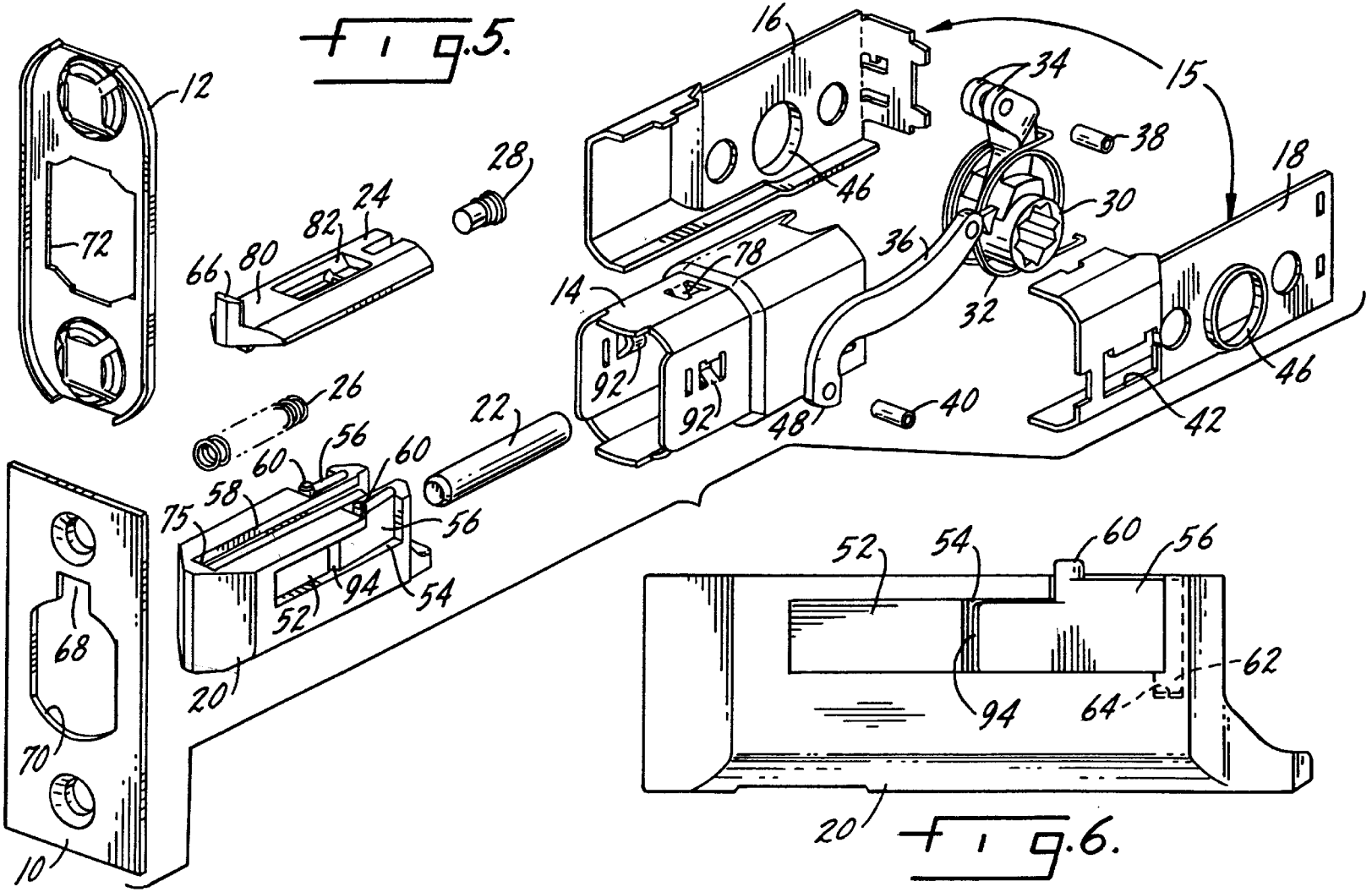
FIG. 5 is an exploded view illustrating the deadbolt.
FIG. 6 is a side view of the bolt.
Figure 7:
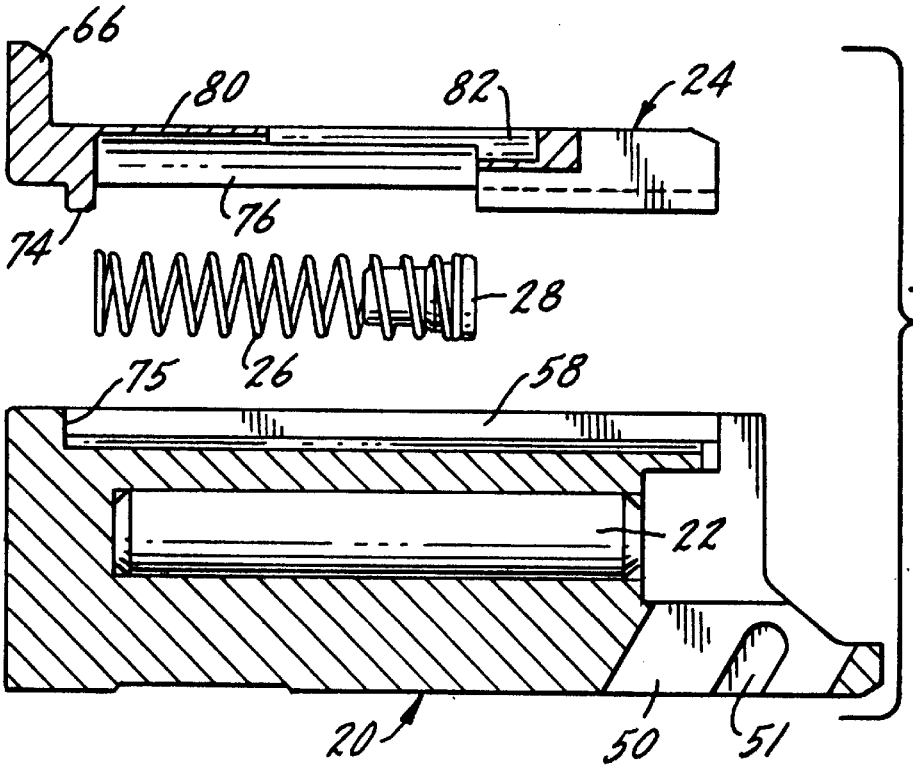
FIG. 7 is an exploded side view of the bolt and plunger.
Figure 8:
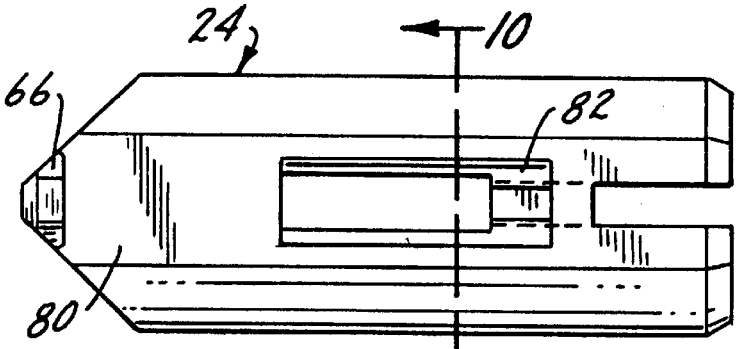
FIG. 8 is a top view of the plunger.
Figure 9:
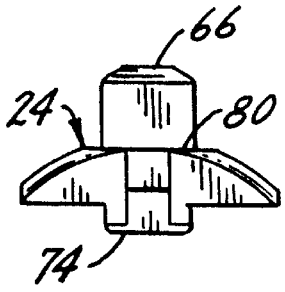
FIG. 9 is a rear view of the plunger.

The component parts of the lock mechanism are illustrated particularly in FIG. 5. There is a faceplate 10, which will normally be visible from the edge of the door, and there is a front plate 12 normally directly behind the faceplate. There is a front case 14 which may be joined to the front plate 12 and there is a rear case 15, telescopically adjustable relative to the front case, and made up of rear case halves or sections 16 and 18. The deadbolt is indicated at 20 and it may have positioned therein a steel pin 22 which is used to resist vandalism. A plunger 24 will ride on top of the bolt 20 and it has a plunger spring 26, one end of which is held by a retaining pin 28.

A swivel is indicated generally at 30 and has a coiled spring 32 which provides the necessary force to urge the bolt 20 in an outward direction. The swivel has a pair of ears 34 to which is connected a link 36 by means of a pin 38 which passes through the aligned holes in the ears 34 and the link 36. The opposite end of link 36 will be connected to the bolt by a pin 40, with the details of such connection being shown in my U.S. Pat. No. 5,516,160, the disclosure of which is herein incorporated by reference.

The telescoping front and rear cases provide for adjustable backset. The rear case section 15 has a somewhat H-shaped opening 42 which cooperates with a detent 44 on the front case 14. The detent will move between the two elongated portions of the opening 42 in moving from one backset position to another.

The swivel 30 will extend through aligned openings 46 in the rear case 15 and is rotatable within those openings. Rotation of the swivel by a spindle (not shown) will be effective to move the deadbolt between a fully extended position and a retracted position during normal release of the lock.

Bolt 20 is shown in detail in FIGS. 6, 7, 12, 13 and 14. End 48 of the link 36 will extend within a rear slot 50 of the bolt and the pin 40 will ride within a groove 51 as the link causes movement of the deadbolt between its several positions. Again, the disclosure on this particular feature is shown in more detail in the '160 patent herein incorporated by reference.

Figure 12:
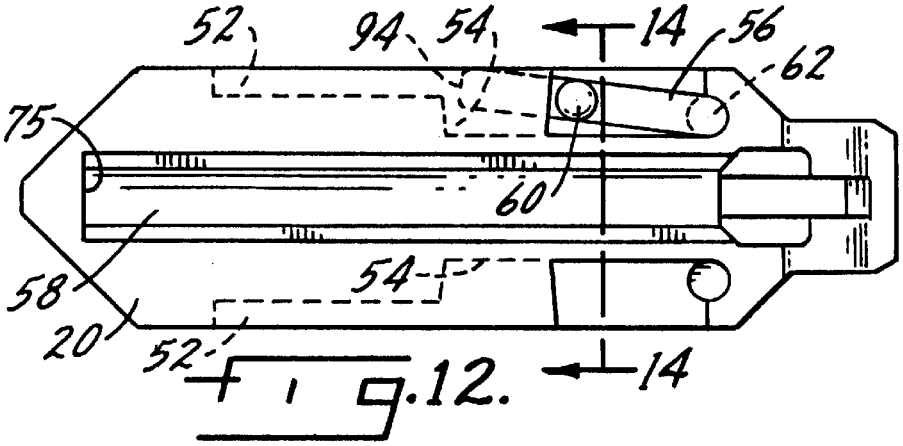
FIG. 12 is a top view of the bolt.
Figure 13:
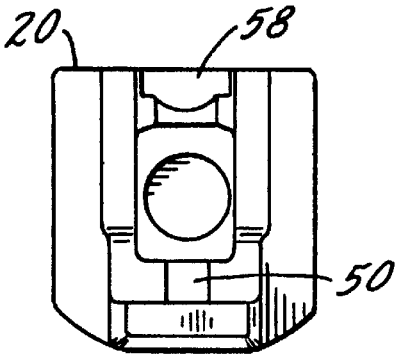
FIG. 13 is a rear view of the bolt.
Figure 14:
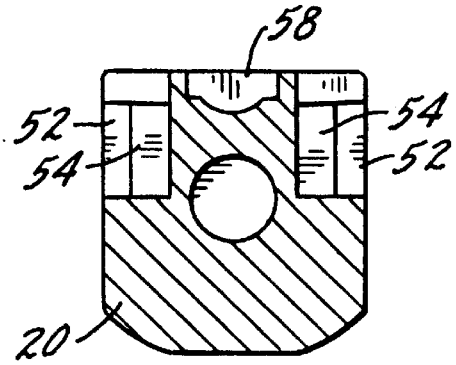
FIG. 14 is a section along plane 14—14 of FIG. 12.

The bolt 20 has a pair of side slots 52, each of which has an enlarged area 54, shown in dotted lines in FIG. 12, within which are positioned stop members 56. The stop members pivotally move between the extended position illustrated in FIGS. 3, 12 and 15, and a retracted position in which the stop member lies totally within the enlarged portion 54 of the slots 52, as shown in FIG. 2. The bolt further has a track 58 along its upper surface, which track accommodates the plunger 24, as described hereinafter. Each of the stops 56, as shown particularly in FIG. 4, has an upwardly-extending pin 60 and a downwardly-extending pin 62. Each pin 62 is journaled in a bore 64, illustrated in dotted lines in FIG. 6, and provides for pivotal movement of the stop members. Each pin 60 will coact with the plunger, with relative movement between the plunger and the bolt causing pivotal movement of each of the stops 56.

Figure 15:
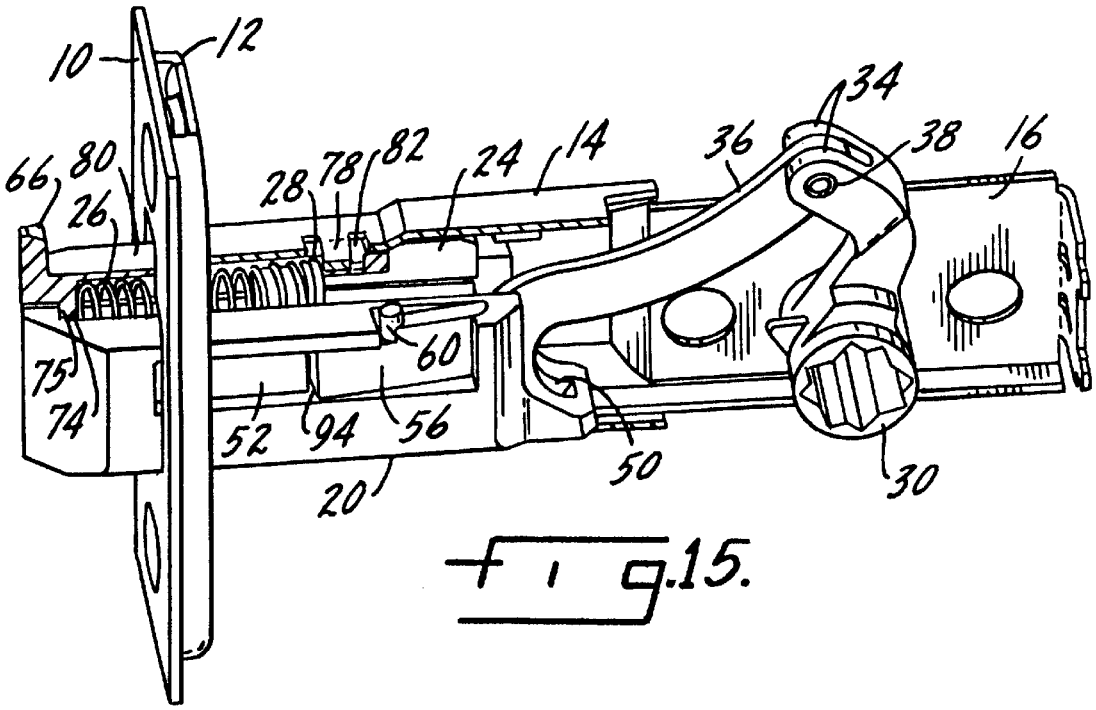
FIG. 15 is a perspective of the deadbolt with a portion of the front casing removed and showing the deadbolt in a partially extended position.

The plunger 24 is illustrated in FIGS. 7–11. It has a front upper generally triangular-shaped projection 66 which is of a size and shape to pass through the upper portion 68 of the opening 70 of faceplate 10. However, it will not pass through the opening 72 of front plate 12 and thus front plate 12 limits the extent of inward movement of the plunger. The plunger has a bottom projection 74 which rides within the top track 58 of the bolt 20 providing for alignment between these elements during both concurrent and relative movement. The plunger spring 26 fits within a downwardly-facing recess 76, with one end of the spring bottoming against projection 74 and the other end of the spring holding pin 28. The pin 28 extends upwardly through the plunger and extends above the profile of the plunger and is in bottoming contact with a stake 78 on the front case 14. The stake 78 is also shown in FIG. 15 which illustrates the relationship between the stake, the pin 28 and the spring 26. The stake provides a bottoming surface for the spring.

The front portion of spring 26 is held in position not only by the projection 74, but by the covering portion 80 of the plunger. The stake 78 extends downwardly into an upper groove 82 on the top of the plunger to limit outward movement of the plunger.

Figure 11:
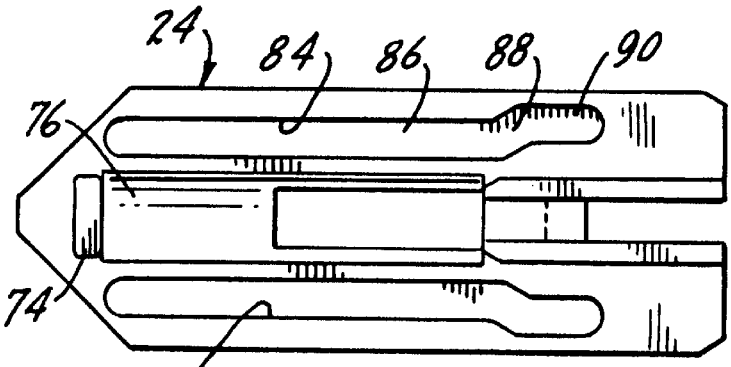
FIG. 11 is a bottom view of the plunger.
Figure 10:
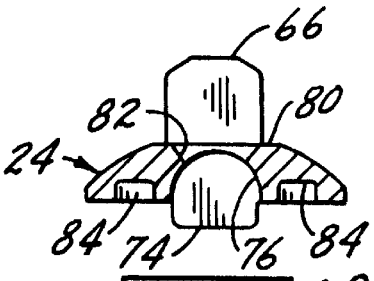
FIG. 10 is a section along plane 10—10 of FIG. 8.

The underside of the plunger is illustrated particularly in FIGS. 10 and 11. There are a pair of parallel cam tracks 84, each of which has an elongated section 86, an out-turned section 88, and then a short section 90 which is parallel to the elongated section 86. The pins 60 of stops 56 will ride in the cam tracks 84 when there is relative movement between the plunger and the bolt.

In operation, and beginning with the deadbolt mechanism in the partially extended position of FIG. 1, the plunger will be limited in its outward movement by contact between the bottom projection 74 of the plunger and the front wall 75 of track 58 in the top of the bolt. The bolt will be prevented from outward movement by contact between stakes 92 on each side of the front case 14 and the outwardly-extending nose 94 of each of the stops 56. In this condition, the bolt is set to be fully extended upon contact between the plunger and a door strike.

When the door is closed, both the bolt and the plunger will contact the door strike and will be moved to a full inward position in which the nose of each of these elements is either flush or close to flush with the front of faceplate 10. The distance through which the bolt and the plunger will be permitted to extend as these elements pass the door strike will depend on the clearance between the door and the door frame. As soon as the bolt 20 is in alignment with the opening in the door strike, the bolt will begin forward movement to a fully extended position. However, since the opening in the door strike is not of the correct shape to accommodate the plunger 24, it will remain in an essentially retracted position. The pins 60 of the stops 56 will be located in the sections 90 of the cam tracks 84 on the bottom of the plunger. As the bolt begins its forward movement toward full extension, the pins 60 will move in the portions 88 of the tracks 84, causing the stops to pivot to a retracted position in which the stops are totally within the recessed areas 54 of the slots 52. As soon as the stops have reached such a retracted position, the bolt can no longer be held by the stakes 92 and thus the bolt is permitted to move to its full extended position. Thus, the bolt will be fully extended and the plunger will remain essentially retracted by contact with the door strike.

The lock is released by rotation of the swivel which, through movement of the link 36, will retract the bolt to a fully or essentially fully retracted position to permit the door to open. As the bolt moves inwardly as driven by the spindle, the plunger will move with it because of the co-action between projection 74 and wall 75 on the plunger and bolt, respectively. Once the door has cleared the door frame, and specifically the door strike, release of the spindle will cause the bolt and plunger to move to the partially extended position of FIG. 1. They will be driven in this direction by the spring 32 which surrounds the swivel 30, with the spring having one end bearing against the ears 34 of the swivel to which the link 36 is connected, with the other end of the spring being bottomed on the floor of the rear case 15. However, the bolt can only be moved to the partially extended position because the pins 60 of the stops 56 will have moved into cam track sections 90 causing the stops to pivot outwardly to the point where they are in contact with the stakes 92, preventing further outward movement of the bolt.

Retraction of the bolt by the spindle will cause relative movement between bolt and plunger, which movement will cause the pins 60 of stops 56 to move in cam tracks 84 and be positioned in track portions 90 when the bolt is fully retracted. When the spindle is released, the bolt and plunger will simultaneously move to the partially extended position by bolt spring 32 and plunger spring 26. Further outward movement of the bolt is limited by stakes 92 and further outward movement of the plunger is limited by wall 75 of the bolt.

The automatic deadbolt of the present invention has a limited number of parts, is extremely reliable, and relies upon the pivotal movement of a pair of stops to hold the bolt in a partially extended position, with the stops being retracted once the plunger and bolt have moved relative to each other. The inward movement of these two elements caused by contact with the door strike moves the stops 56 rearwardly of the stakes 92, thus permitting a space within which the stops can retract prior to reaching the area of the stakes when the bolt is moving to its fully extended position.

Whereas the preferred form of the invention has been shown and described herein, it should be realized that there may be many modifications, substitutions and alterations thereto.

The embodiments of the invention in which an exclusive property or privilege is claimed are defined as follows:

1. An automatic door latch having a case, a bolt movable within said case between a fully extended position in which said bolt extends forwardly of said case and a partially extended position in which said bolt is positioned to contact a door strike, a plunger mounted on said bolt, said bolt and plunger being relatively movable, a bolt spring biasing said bolt toward a fully extended position, a plunger spring biasing said plunger outwardly of said case, means limiting outward movement of said plunger to a position in which its extension is the same as said bolt in its partially extended position, at least one bolt stop on said bolt movable toward and away from said case, said at least one bolt stop being pivotably affixed at one end to said bolt and having a cam pin at an opposite end thereon, means on said case coacting with said at least one bolt stop to limit bolt extension to its partially extended position, cam means on said plunger cooperating with said at least one bolt stop to cause movement of said at least one bolt stop away from said case and toward said bolt during outward movement of said bolt relative to said plunger to permit said bolt to move to a fully extended position, the cam means acting on the cam pin to pivotally move a free end of the at least one bolt stop away from and toward said bolt.

2. The automatic door latch of claim 1 including a bolt stop on each side of said bolt, the means on said case coacting with the bolt stop including an inward projection on each side of the case, each projection being positioned to coact with a bolt stop.

3. The automatic door latch of claim 1 wherein said cam means includes a track on the bottom of said plunger, said cam pin positioned within said track with relative movement between the bolt and plunger causing said cam pin and track to provide for relative movement of said at least one bolt stop toward and away from said bolt.

4. The automatic door latch of claim 3 wherein there is a bolt stop on each side of said bolt, and said plunger has parallel cam tracks coacting with said bolt stops.

5. The automatic door latch of claim 1 including a track on the top of said bolt, said plunger having a portion movable in said bolt track.

6. The automatic door latch of claim 5 including an inward projection on the top of said case limiting movement of said plunger.

7. The automatic door latch of claim 6 including a slot in said plunger, said plunger spring being positioned within said slot.

8. The automatic door latch of claim 1 wherein said bolt spring is positioned within said case.

9. The automatic door latch of claim 1 including a slot on each side of said bolt, a bolt stop positioned in each slot with each stop coacting with an inward extension from said case to limit bolt movement.

10. The automatic door latch of claim 9 including a projection on each side of said case extending inwardly toward said bolt and into said bolt slot.

11. The automatic door latch of claim 10 wherein each bolt stop has an upwardly extending projection, a pair of parallel cam tracks on the underside of said plunger for receiving said bolt stop projections whereby relative movement between said bolt and plunger cause said bolt stops to pivot toward and away from said bolt and case.

12. The automatic door latch of claim 1 wherein said case includes a swivel, a link connecting said swivel and said bolt, said bolt spring extending about said swivel and normally urging said bolt outwardly from said case.

13. The automatic door latch of claim 1 wherein the axis of said cam pin is parallel to and offset from the pivot axis of said at least one bolt stop.

* * * * *